US006155960A

United States Patent [19]

Roberts et al.

[11] Patent Number: 6,155,960

[45] Date of Patent: Dec. 5, 2000

[54] TRAINING DUMMY ASSEMBLY IN HUMAN FORM

[76] Inventors: Donald Roberts; Anthony Grano, both of 303 W. State St., Geneva, Ill. 60134; Frederick Roberts, 508 S. Harvard, Addison, Ill. 60101

[21] Appl. No.: 09/071,221

[22] Filed: May 1, 1998

[51] Int. Cl.[7] ..... A63B 69/00

[52] U.S. Cl. ..... 482/83; 482/87; 482/90

[58] Field of Search ..... 482/83, 84, 85, 482/86, 87, 88, 89, 90; 434/247, 257, 256, 262, 267, 274; 73/866.4

[56] References Cited

U.S. PATENT DOCUMENTS

| | | | |
|---|---|---|---|
| 329,880 | 11/1885 | Beacock et al. . | |
| 1,708,638 | 4/1929 | Smith | 482/83 |
| 1,909,461 | 5/1933 | Costa . | |
| 4,434,980 | 3/1984 | Babineaux . | |
| 4,765,609 | 8/1988 | Wilson . | |
| 4,852,554 | 8/1989 | Alten . | |
| 4,989,862 | 2/1991 | Curtis . | |
| 5,018,977 | 5/1991 | Wiley | 434/274 |
| 5,256,069 | 10/1993 | Snowden | 434/247 |
| 5,340,059 | 8/1994 | Kanigoski . | |
| 5,352,170 | 10/1994 | Condo . | |
| 5,700,230 | 12/1997 | Cardona | 482/83 |

*Primary Examiner*—Jerome W. Donnelly
*Attorney, Agent, or Firm*—Susan M. Keating; Orum & Roth

[57] ABSTRACT

A training dummy in human form that mimics realistic human movements and reactions to forces extended onto the dummy by a user, and including a torso having at least one upper arm attachment point with an XY & Z axis, at least one upper arm fastened to the torso at the at least one upper arm attachment point and capable of rotating about the X axis and pivoting about the XY & Z axis of the upper arm attachment point. A returning means securely attached to the dummy for returning the upper arm and torso back to their initial positions after having a twisting, restraining, or striking force exerted upon the dummy. A counterbalancing means attached to the torso for counterbalancing a force applied to the dummy. The dummy is suspended from the counterbalancing means which tends to return the dummy to an upright position if the dummy is taken down to the floor.

17 Claims, 5 Drawing Sheets

FIG. 9
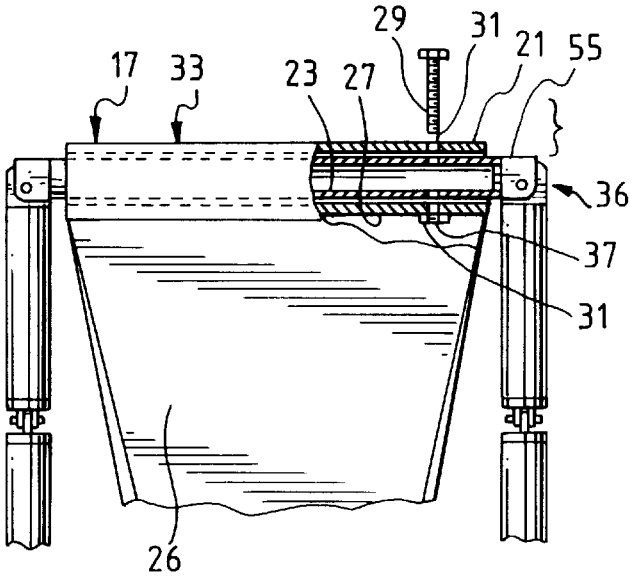
FIG. 10
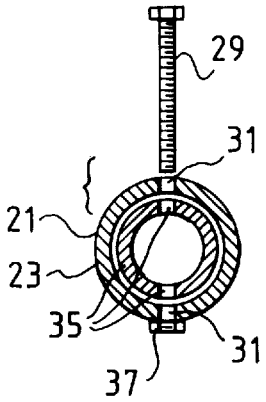
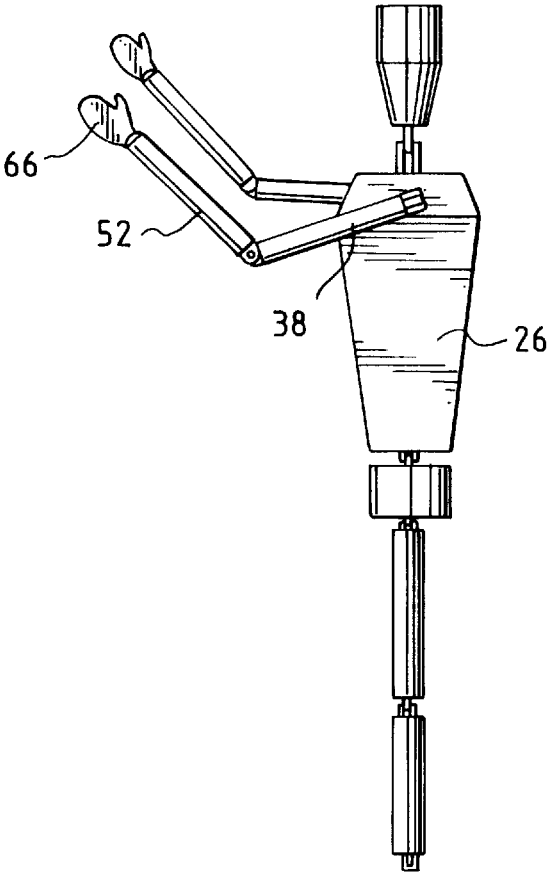
FIG. 11

TRAINING DUMMY ASSEMBLY IN HUMAN FORM

BACKGROUND OF THE INVENTION

1. Field of the Invention

The present invention relates to training dummy assemblies used in the practice of martial arts, boxing, self defense, or police related techniques for restraining suspects. More particularly, the invention relates to a training dummy assembly that mimics realistic human movements and reactions to forces exerted onto the dummy by a user, such as twisting, restraining, striking and take down forces, and tends to return the dummy to its initial and upright position after being twisted, restrained, struck or taken down to the floor.

2. Description of the Related Art

Training dummies have been disclosed which react passively and do not mimic real human reactions to forces exerted by a user onto the dummy. One common dummy has a tubular shaped stuffed bag covered in canvas or leather, and suspended from above. This type of dummy is commonly known as a "heavy bag". Blows are absorbed by the stuffing, simulating the ability of a body to absorb the hits. Various energy absorbing devices have been used in connection with these type of dummies, to absorb forces exerted against the dummy, such as springs to suspend the dummy from above, or fluid filled stands to support the dummy from below.

Other devices have been proposed which simulate the shape of the human form, however, they do not simulate the movements or reactions of a human when forces are exerted against the dummy.

None of the previous training dummies simulate the appearance of a human and have the ability to move and react in a very realistic manner when forces are exerted against the dummy.

SUMMARY OF THE INVENTION

The principal object of the invention is to provide a new and improved having dummy assembly in human form that mimics realistic human movements and reactions to twisting, restraining, striking and take d own forces exerted against the dummy. It is also a principal object of the invention to provide a training dummy that employs limb joints which are moveable in a human like manner.

It is also an object of the invention to provide a training dummy assembly having counterbalancing means attached to the dummy for returning the dummy to an upright position after the dummy is taken down to the floor.

It is also an object of the invention to provide a training dummy assembly including a returning means fastened to the dummy for returning the dummy to its initial position after twisting, holding or striking forces are exerted against the dummy.

It is also an object of the invention to provide a training dummy assembly having positionable limbs that can be fixed into numerous boxing or fighting poses.

It is a further object of the invention to provide a training dummy assembly with interchangeable arms that are easy to remove and replace.

According to one aspect of the invention, the above objects are realized in a training dummy assembly including a torso having at least one upper arm attachment point having an XY & Z axis at each attachment point, at least one upper arm fastened to the torso at the upper arm attachment point, a shoulder fastening means for fastening the upper arm to the torso and enabling the upper arm to rotate about the X axis and pivot about the Y and Z axes. A counterbalancing means adapted for counterbalancing a force applied to the dummy is attached to the torso. In one embodiment of the invention the upper arm rotates at least about 180° about the X axis, and pivots at least about 180° about the Y and Z axes.

In one embodiment of the invention the shoulder fastening means includes an assembly comprising a combination swivel joint and pivoting hinge, wherein the swivel joint is fastened to the torso and the pivoting hinge, including at least one protuberance adjacent the swivel joint, is fastened to the upper arm. The swivel joint includes at least two stops adjacent the pivoting hinge, that in combination with said at least one protuberance limits the rotating range of the upper arm to about 270° about the X axis.

In another embodiment of the invention the upper arm includes a lower arm attachment point having an XY & Z axis and further comprises a lower arm fastened to said at least one upper arm. An elbow fastening means for fastening the lower arm to the upper arm is included, and enables the lower arm to pivot at least about 90° about the X axis and rotate at least about 90° about the Y axis of the lower arm attachment point.

In one embodiment of the invention the elbow fastening means includes an assembly comprised of a combination swivel joint and pivoting hinge, wherein the swivel joint is fastened to the upper arm, the pivoting hinge, including at least one protuberance located adjacent the swivel joint, is fastened to the lower arm. At least two stops are located at an end of the upper arm adjacent the pivoting hinge, and in combination with the protuberance of the pivoting hinge, the rotating range of the lower arm is limited to about 180° about the Y axis.

In one embodiment of the invention the lower arm further comprises a hand attachment point having an XY & Z axis and further comprises a hand fastened to the lower arm and a wrist fastening means for fastening the hand to the hand attachment point. The wrist fastening means enables the hand to pivot at least about 90° about the Z axis.

In one embodiment of the invention the wrist fastening means includes a hinge with a base part and a single knuckle. The base part is fastened to the lower arm at the hand attachment point and the single knuckle is fastened to the hand.

In another embodiment of the invention the torso further comprises a head attachment point having an XY & Z axis, a head fastened to the torso and a head fastening means for fastening the head to the torso and enabling the head to pivot at least about 90° about the Y axis of the head attachment point.

In one embodiment of the invention the counterbalancing means is attached to the head.

In another embodiment of the invention the counterbalancing means includes at least a single pulley system wherein a counterbalancing weight is suspended from an upper support and the dummy is suspended from the upper support. The counterbalancing weight is equal to a weight of the dummy.

In yet another embodiment of the invention the head, torso, upper arm, lower arm and hand each have initial positions, and the dummy further comprises a returning means for returning the head, torso, upper arm, lower arm and hand back to their initial positions after a twisting, rotating or pivoting force is applied to the dummy. The returning means includes a combination energy storing material and resilient covering securely attached to the dummy.

According to still yet another facet of the invention the above objects are realize in a training dummy assembly in human form comprising a torso including at least one upper arm attachment point having an XY & Z axis at each attachment point, and chamber forming part of the torso and encompassing said at least one upper arm attachment point, and including an outer surface. A carrier is slipped into the chamber and concentric with the chamber. The carrier rotates with respect to the chamber about the X axis of the upper arm attachment point, and the carrier and chamber include a common securing means for securing the carrier at at least one, and preferably three discrete points as it rotates with respect to the chamber. At least one upper arm is fastened to the carrier at the upper arm attachment point, and the securing means enables the carrier to be secured within the torso and the upper arm to be positioned at three discrete arm positions with respect to the torso.

In one embodiment of the invention the securing means includes a bolt, two diametrically opposed holes of the chamber, a nut attached to the outer surface of the chamber and concentric with at least one of the diametrically opposed holes of the chamber, and at least one but preferably three sets of diametrically opposed holes of the carrier, wherein at least one of the sets is aligned with the two diametrically opposed holes of the chamber. The bolt is inserted through the diametrically opposed holes in the chamber and at least one of the sets of diametrically opposed holes of the carrier and fastened to the nut. The bolt thereby secures the carrier within the torso and stops the rotation of the carrier and the attached upper arm at a discrete point with respect to the torso.

Other aspects and advantages of the invention will become apparent from the following specification taken in connection with the accompanying drawings.

DESCRIPTION OF THE DRAWINGS

FIG. 9 is a view of the torso further detailing in partial cross section the securing means of the invention;

FIG. 10 is a side view of the securing means in cross section;

FIG. 11 is a side view of an embodiment of the invention arranged in a boxing pose.

DESCRIPTION OF THE PREFERRED EMBODIMENT

Figure 1:
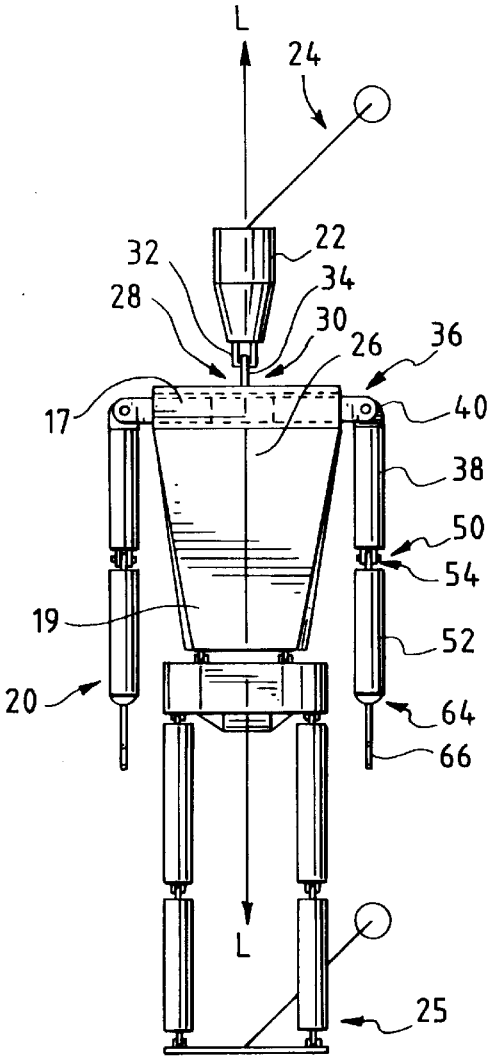
FIG. 1 is a front view of an embodiment of the training dummy assembly of the invention.

The training dummy assembly generally designated 20, as disclosed in the illustrative embodiment of FIG. 1, is seen to include a human form. The training dummy assembly is formed from stainless steel with its parts welded together, however the dummy assembly can be formed from other materials such as other metals plastic or other semi-rigid elastomeric and compressible materials with its parts welded, soldered, glued, bolted or joined together by any method well known in the art.

The training dummy assembly as shown in FIG. 1 is about the size of an average adult human, but weights only about 50 pounds. An adult user can practice martial arts, boxing, self defense, or police related techniques for restraining suspects on the training dummy assembly of the present invention. The training dummy assembly according to the invention can also be made smaller or larger as well as lighter or heavier. A smaller and lighter dummy assembly can accommodate a child user, and a larger and heavier dummy assembly can accommodate a larger than average adult user. Likewise each body part of the training dummy assembly is about the size of an average adult's body part, however each part can also be smaller or larger to accommodate a smaller or larger user as described above.

The training dummy assembly 20, as shown in FIG. 1, includes a head 22 that is attached to an upper support 24. The head 22 is generally cylindrical and tapered at one end.

The upper support 24 as shown in FIG. 1 is a cable attached to a wall (not shown), but can include a rope, chain, bar, or spring attached to a wall or other stationary object. The upper support can also be attached to a portable or stationary stand.

A torso 26 is attached to the head 22 as seen in FIG. 1, and includes a head attachment point 28 having an XY & Z axis. The torso includes a shoulder section 17 and a waist section 19, wherein the shoulder section 17 is wider and tapers down to the waist section 19. The torso can also be generally rectangular in shape with less dramatic tapering from the shoulder section 17 to the waist section 19.

The training dummy as shown on FIG. 1 further includes a head fastening means 30 for fastening the head 22 to the torso 26. The head fastening means 30 enables the head 22 to pivot about the Y axis of the head attachment point 28.

The head fastening means 30 as shown in FIG. 1 includes a closed U-shaped finger 32 attached to the head 22 and interconnected with a closed U-shaped finger 34 attached to the torso 26 at the head attachment point 28; each finger is preferably of equal dimensional size. The head fastening means 30 enables the head 22 to pivot at least about 90° about the Y axis of the head attachment point 28. The head fastening means can incorporate any fastening means well known in the art such as a cable or rope that will enable the head to rotate at least about 90° about the Y axis of the head attachment point 28.

As with additional closed U-shaped finger joint fastening means to be described below, the head fastening means can include more than one set of interconnected-shaped fingers. Additionally the U-shaped fingers are formed from steel round stock or bar having a ¼ or ½ inch diameter and can be formed from stainless steels.

As shown in FIG. 1, a longitudinal axis (L) of the training dummy assembly splits the dummy into a right side and left side, wherein the right side of the training dummy assembly is a mirror image of the left side of the training dummy. As a result, the further description of the training dummy assembly will include only a description of the left side of the dummy, with the right side of the dummy being understood to include a mirror image of each and every element of the left side of the dummy.

The torso 26 further includes at least one upper arm attachment point having an XY & Z axis at each said attachment point. The training dummy assembly as shown in FIG. 1 includes an upper arm attachment point 36, having an XY & Z axis, and an upper arm 38 fastened to the torso at the upper arm attachment point 36. The upper arm 38 as shown in FIG. 1 is generally tubular and hollow, but the upper arm can be generally rectangular in shape, flat and solid throughout.

A shoulder fastening means 40 for fastening the upper arm 38 to the upper arm attachment point 36 of the torso 26, enables the upper arm 38 to rotate about the X axis and pivot about the Y and Z axes of the upper arm attachment point 36. Preferably, the shoulder fastening means 40 enables the upper arm 38 to rotate at least about 180° about the X axis, and pivot at least about 180° about the Y and Z axes of the upper arm attachment point 36.

Figure 2:
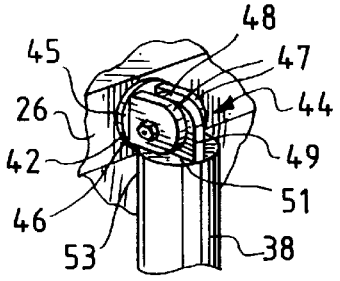
FIG. 2 is a perspective view of a shoulder means of the invention.

The shoulder fastening means 40 as seen in FIGS. 1 and 2, includes an assembly comprised of a combination swivel joint 42 and pivoting hinge 44. The swivel joint 42 is fastened to the torso 26 and the pivoting hinge 44 is fastened to the upper arm 38. The swivel joint 42 includes at least two stops 46 (only one of which is shown) and the pivoting hinge 44 includes at least one protuberance 48. The stops 46 of the swivel joint 42, in combination with the protuberance 48 of the pivoting hinge 44, limits the rotating range of the upper arm 38 to about 270° about the X axis of the upper arm attachment point 36.

The swivel joint 42 may include only one stop 46, in combination with two protuberances 48 of the pivoting hinge 44, to limit the rotating range of the upper arm 38 to about 270° about the X axis. Additionally, the stops 46 may be attached to the torso 26 at the upper arm attachment point 36, instead of the swivel joint 42.

The swivel joint 42 as seen in FIG. 2, includes a disc 56 that is rotatably attached to the pivoting hinge 44. A bolt (similarly shown as 57 in FIGS. 3 and 4) rotatably attaches the swivel joint 42 to the pivoting hinge 44. The pivoting hinge 44 includes a first part comprising a disc 45 attached to a forked member 47 which is comprised of two U-shaped plates. The first part is pivotably connected to a second part comprising a plate 49 attached to and bisecting a disc 51. The second part pivots about bolt 53 wherein when the plate 49 is rotatably displaced between the U-shaped plates of the forked member 47. The swivel joint and pivoting hinge as shown in FIGS. 1 and 2 are formed from steel, however they can be formed from stainless steel or other metals and hard plastics.

Figure 6:
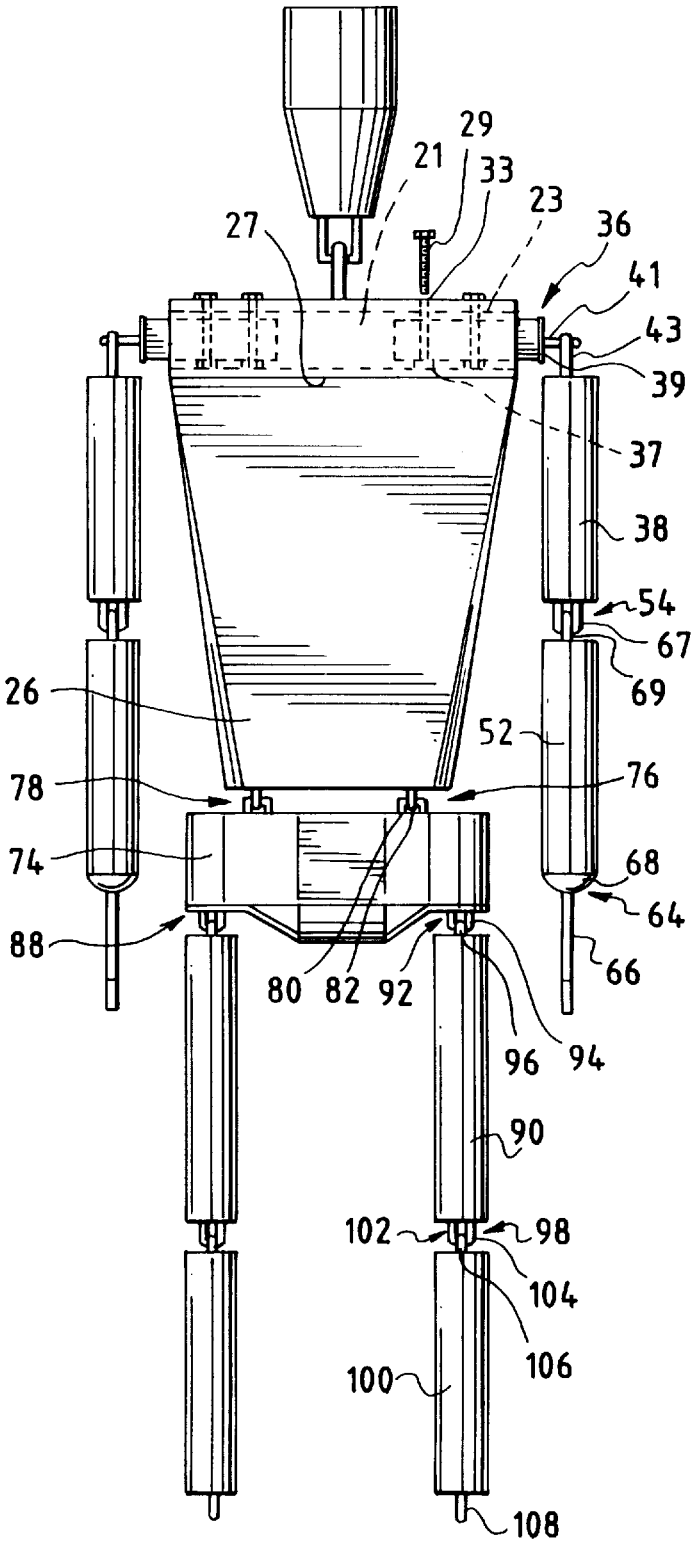
FIG. 6 is a front view of an embodiment of the present invention.

The shoulder fastening means 40, as shown in the embodiment illustrated in FIG. 6, includes a chamber 21 forming part of the torso 26 and encompassing at least one upper arm attachment point 36. The chamber includes an outer surface 27. At least one carrier 23 is slipped into the chamber 21 and concentric with the chamber 21. As shown in FIG. 6, two carriers are slipped into the chamber 21. The chamber 21 and carrier 23 as shown in FIG. 6 are tubular, however the chamber 21 and carrier 23 can be rectangular or any other geometric shape that allows the carrier 23 to slip in and out of the chamber 21.

The carrier 23 rotates with respect to the chamber 21 about the X axis of the upper arm attachment point 36. The carrier 23 and the chamber 21 include a common securing means for securing the carrier 23 at a discrete point with respect to the chamber 21. The securing means as seen in FIGS. 6 and 9, includes at least one bolt 29, two diametrically opposed holes 31 of the chamber 21, and a hole 33 (See FIG. 9) in the torso 26 aligned with at least one diametrically opposed hole 31 of the chamber 21. Also included are at least two diametrically opposed holes 35 of the carrier 23 aligned with the diametrically opposed holes 31 of the chamber 21, and a nut 37 attached to the outer surface 27 of the chamber 21 and aligned with at least one of the diametrically opposed holes 31 of the chamber 21. The bolt 29 is inserted through the hole 33, the diametrically opposed holes 31, the diametrically opposed holes 35 and secured to the nut 37, thereby securing the carrier 23 to the torso 26 and stopping the carrier 23 from rotating with respect to the chamber 21 and torso 26.

A plate 39 is attached to the carrier 23, at the upper arm attachment point 36, and the upper arm 38 is attached to plate 39. A closed U-shaped finger 41 is attached to the plate 39 and interconnected with a closed U-shaped finger 43 attached to the upper arm 38.

The training dummy assembly can include two sets of securing means as seen in FIG. 6, providing for two bolts to be fastened to the carrier 23. Additionally, the dummy assembly can include two separate carriers 23, one for securing the left upper arm to the torso, and the other carrier for securing the right upper arm to the torso. Each carrier 23 can slide in and out of the chamber 21 when the bolt 29 is released from the security means. This arrangement provides for a training dummy assembly with easily removable and replaceable and interchangeable arms.

Figure 3:
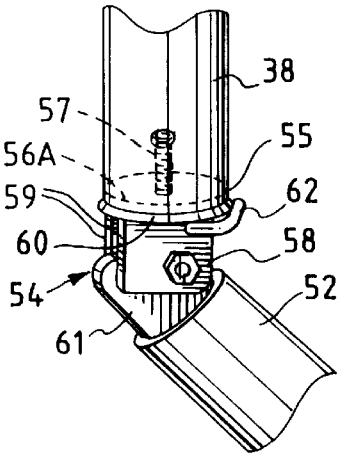
FIG. 3 is a perspective view of an elbow means of the invention.

The upper arm 38 as seen in FIGS. 1 and 3, includes a lower arm attachment point 50 having an XY & Z axis. A lower arm 52 is attached to the upper arm at the lower arm attachment point 50. As with the upper arm 38, the lower arm 52 as shown in FIG. 1 is generally tubular and hollow, but the lower arm can be generally rectangular in shape, flat and solid throughout.

As shown in FIGS. 1 and 3, an elbow fastening means 54 for fastening the lower arm 52 to the upper arm 38 enables the lower arm 52 to pivot about the X axis and rotate about the Y axis of the lower arm attachment point 50. Preferably, the elbow fastening means 54 as shown in FIGS. 1 and 3–4 enables the lower arm 52 to pivot at least about 90° about the X axis and rotate at least about 90° about the Y axis of the lower arm attachment point 50.

The elbow fastening means as shown in FIG. 3 includes an assembly comprised of a combination swivel joint 56 and pivoting hinge 58. The swivel joint 56 is fastened to the upper arm 38, and the pivoting hinge 58 is fastened to the lower arm 52. As seen in FIG. 3, at least two diametrically opposed stops 60 (only one is shown) are located at one end of the upper arm adjacent the pivoting hinge, and at least one protuberance 62 of the pivoting hinge 58 is located adjacent the swivel joint. The stops 60 in combination with the protuberance 62 limit the rotating range of the lower arm 52 to about 180° about the Y axis of the lower attachment point 50.

The upper arm 38 may include only one stop 60, while in combination, the pivoting hinge 58 includes two opposed protuberances 62, in order to limit the rotating range of the lower arm to about 180° about the Y axis of the lower arm attachment point 50.

Figure 4:
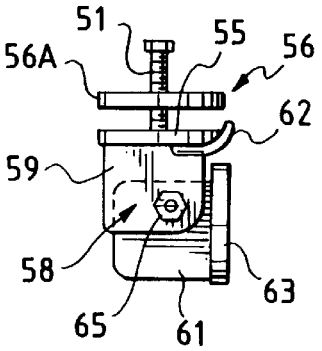
FIG. 4 is an elevational view of the elbow means of the invention.

The swivel joint 56 is rotatably attached to the pivoting hinge 58 as seen in FIGS. 3 and 4 and includes a disc 56A inserted within arm 38 and attached therein. The disc includes a central hole 25. A bolt 57 centrally attached to disk 55 extends through hole 25 of disk 56A and rotatably attaches the swivel joint 56 to the pivoting hinge 58. The pivoting hinge 58 includes a first part comprising a disc 55 attached to a forked member 59, comprised of two plates each having at least one 900 corner, a second part comprising a plate 61 attached to and bisecting a disc 63. The second part pivots about a bolt 65, wherein the plate 61, is displaced between the plates of the forked member 59 to form a pivoting hinge 58.

The swivel joint and pivoting hinge as shown in FIGS. 1 and 3–4 are formed from steel, however they can be formed from stainless steel or other metals and hard plastics.

The elbow fastening means as seen in the embodiment of FIG. 6, includes a closed U-shaped finger 67 attached to the upper arm 38 at the lower arm attachment point 50, interconnected to a closed U-shaped finger 69 attached to the lower arm 52. The elbow fastening means can include any fastening means well known in the art such as a cable or rope for fastening the lower arm to the upper arm and enabling the lower arm to pivot at least about 90° about the X axis and rotate at least about 90° about the Y axis of the lower arm attachment part.

Figure 5:
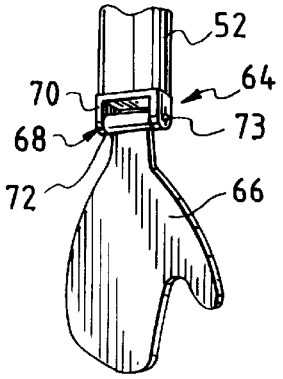
FIG. 5 is a perspective view of a wrist means fastened to a hand of the invention.

The lower arm 52 as seen in FIGS. 1 and 5–6 includes a hand attachment point 64 having an XY & Z axis. A hand 66 is attached to the lower arm 52 at the hand attachment point 64. A wrist fastening means 68 as shown in FIGS. 5 and 6, for fastening the hand to the hand attachment point of the lower arm, enables the hand 66 to pivot about the Z axis of the hand attachment point 64. Preferably, the hand pivots at least about 900 about the Z axis of the hand attachment point 64.

The hand 66 has a generally flat appearance as seen in FIG. 5, and the fingers are not well defined. The hand could include more finger detail and could have a much thicker appearance.

The wrist fastening means as shown in FIG. 5, includes a hinge with a base part 70 and a single knuckle 72. The base part 70 is fastened to the lower arm 52 at the hand attachment point 64, and the knuckle 72 is attached to the hand 66. A pin or bolt 73 pivotably attaches the base part 70 to the single knuckle 72.

The training dummy assembly as illustrated in FIGS. 1 and 6, also includes a pelvis 74 attached to the torso 26. The torso 26 includes at least one pelvis attachment point, and preferably as shown on FIG. 6 includes two pelvis attachment points 76 and 78.

A pelvis fastening means for fastening the pelvis 74 to the torso 26 as seen in FIG. 6 includes a closed U-shaped finger 80 fastened to the torso 26 at the pelvis attachment point 76, and interconnected with a closed U-shaped finger 82 fastened to the pelvis 74. The pelvis fastening means can also include any means for attachment well known in the art such as a cable or rope etc.

The pelvis 74 as shown in FIG. 6 further includes an upper leg attachment point 88 having an XY & Z axis. An upper leg 90 is attached to the pelvis 74 at the upper leg attachment point 88. The upper leg 90 as seen in FIG. 6 is generally tubular and hollow, but can be generally rectangular, flat and solid throughout. An upper leg fastening means 92 for fastening the upper leg 90 to the pelvis 74 enables the upper leg 90 to pivot at least about 90° about the Y axis of the upper leg attachment point 88.

The upper leg fastening means 92 as shown in FIG. 6 includes a closed U-shaped finger 94 attached to the pelvis 74 at the upper leg attachment point 88, interconnected with a closed U-shaped finger 96 attached to the upper leg 90. The upper leg fastening means can include any fastening means well known in the art, such as a cable or rope, that enables the upper leg to pivot at least about 90° about the Y axis of the upper leg attachment point 88.

The upper leg 90 further includes a lower leg attachment point 98 having an XY & Z axis. A lower leg 100 is attached to the upper leg 90 at the lower leg attachment point 98. The lower leg 100 as seen in FIG. 6 is generally tubular and hollow inside, but can be generally rectangular, flat and solid throughout. A lower leg fastening means 102 for fastening the lower leg 100 to the upper leg 90 at the lower leg attachment point 98, enables the lower leg 100 to pivot at least about 90° about the Y axis of the lower leg attachment point 98.

The lower leg fastening means 102 includes a closed U-shaped finger 104 fastened to the lower leg attachment point 98 of the upper leg 90, interconnected with a closed U-shaped finger 106 attached to the lower leg 100. The lower leg fastening means can include any fastening means well known in the art, such as a cable or rope, that enables the lower leg to pivot at least about 90° about the Y axis of the lower leg attachment point 98.

The lower leg 100 as seen in FIG. 6 further includes a lower support hook 108 attached an end of the lower leg 100 opposite the closed U-shaped finger 106.

Figure 7:
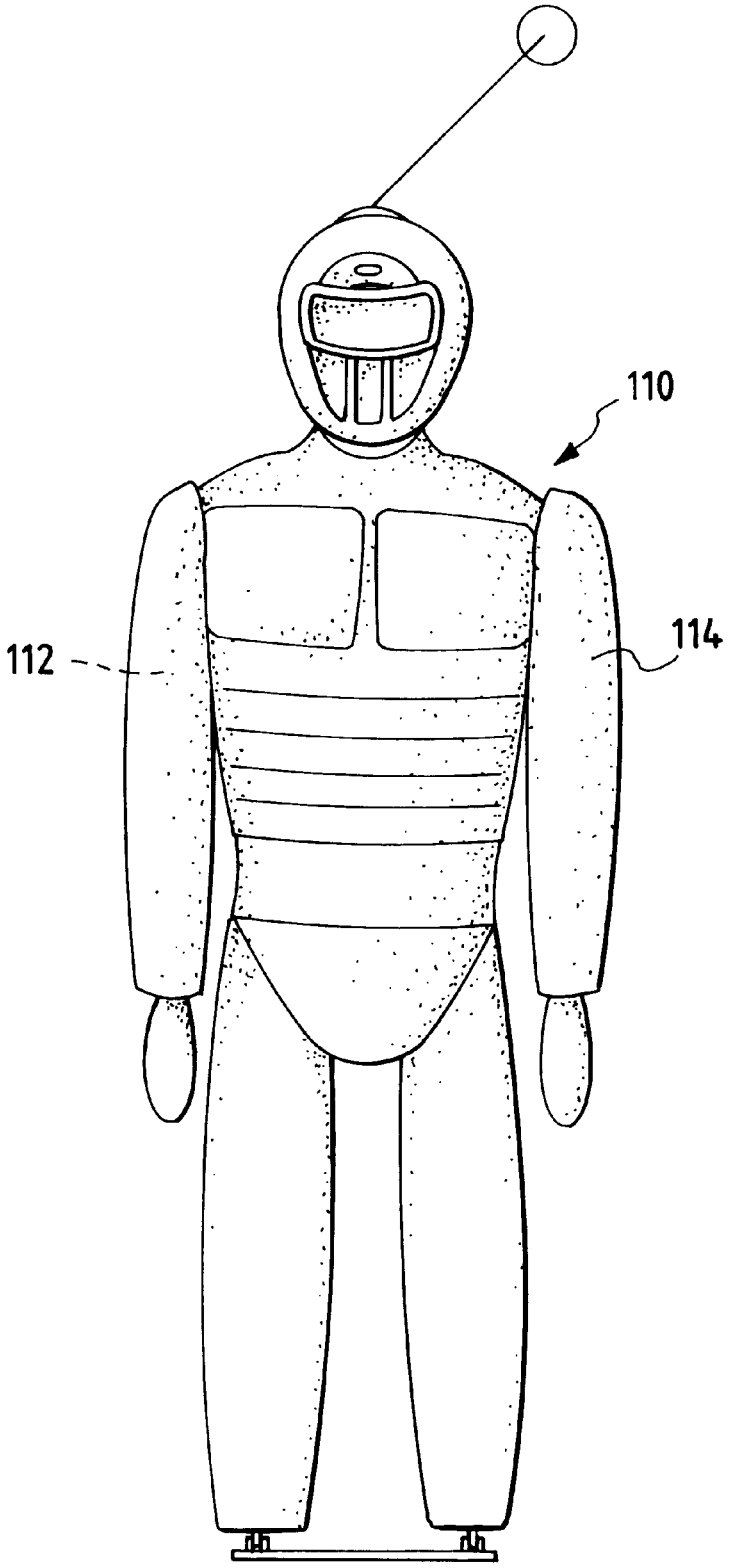
FIG. 7 is a front view of the training dummy assembly including a returning means attached thereto.

The training dummy assembly 22 as seen in FIGS. 1 and 7, has an initial position, prior to twisting, restraining, and striking forces exerted onto the dummy by the user. Likewise, the head 22, torso 26, upper arm 38, lower arm 52, pelvis 74, upper leg 90, and lower leg 100 all have an initial position, as shown in FIGS. 1 and 7, prior to any twisting, restraining, or striking forces exerted upon the dummy.

The training dummy assembly of the present invention further includes a returning means 100 as shown in FIG. 7 for returning the dummy back to its initial positions after a twisting, restraining, or striking force is applied to the dummy. The returning means 100 returns the head, upper arm, lower arm, hand, upper leg and upper leg back to their initial positions after a rotating or pivoting force is applied to these elements.

The returning means as shown in FIG. 7 includes a combination energy storing material 112 and a resilient covering 114 securely attached to the dummy. The energy storing material 112 as seen in FIG. 7, may include textile material, or a foam or padded material and can include a rubber or elastomeric material as well as any other energy storing material well known in the art. The covering 114 as seen in FIG. 7 is shaped to snugly fit the entire dummy 22, and formed from a heavy cotton, blue jeans material, but can be formed from any tightly woven and sturdy material well known in the art.

The covering 114 is lined with the energy storing material 112 and securely attached to the dummy. The covering 114 as shown in FIG. 7 is further tied to the dummy with Velcro® straps, but can be attached to the dummy using adhesives, and other securing methods that are well known in the art. The covering 114 can be formed as a suit shaped to fit the dummy and stuffed with the energy storing material 112. Alternatively, the covering 114 may be loosely attached to the dummy. In one embodiment the covering forms a skin-like or clothing-like cover over the dummy. Movement of an element of the dummy is generally resisted by the covering, which tends to return the element to its original position.

Figure 8:
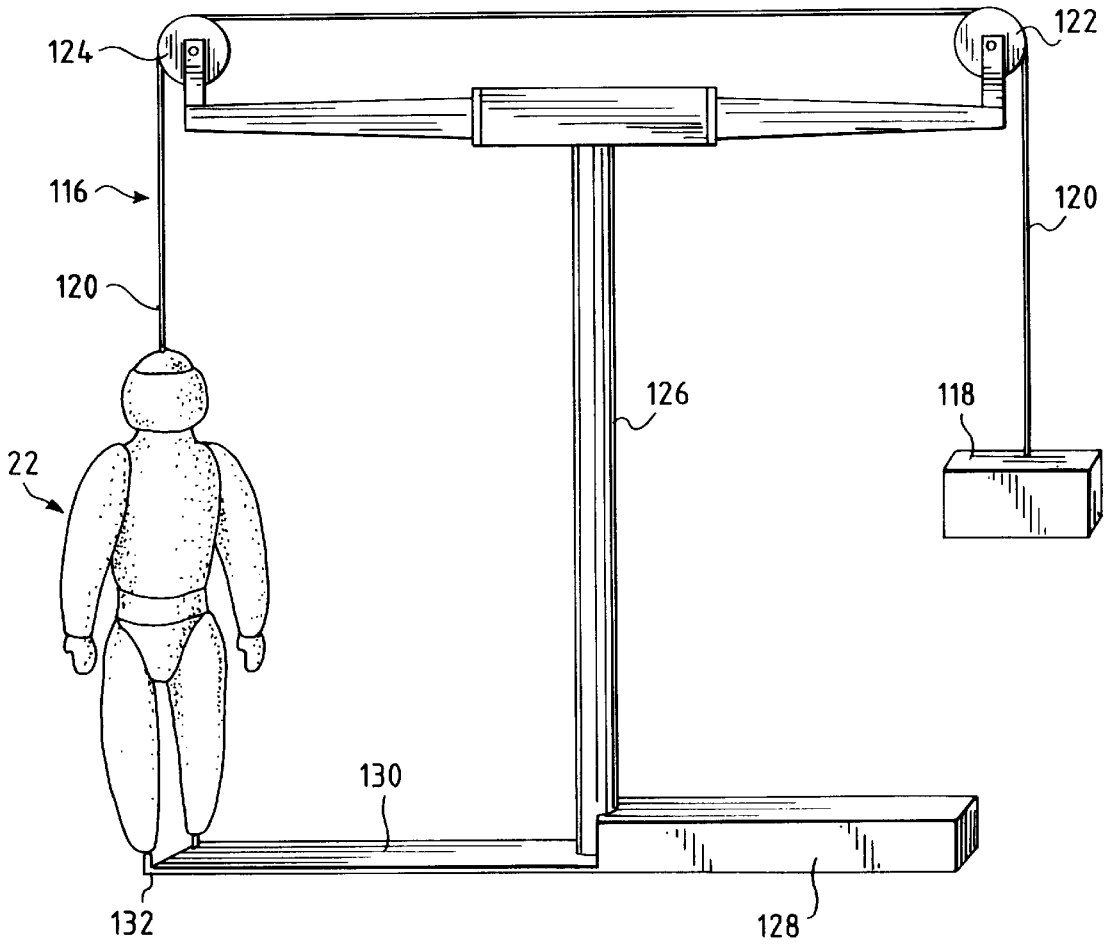
FIG. 8 is a perspective view of a counterbalancing means of the invention.

A counterbalancing means 116 as shown in FIG. 8, is adapted for counterbalancing a force applied to the dummy 22. The counterbalancing means 116 includes a single pulley system wherein a counterbalancing weight 118 is suspended by a cable 120 from a pulley 122, and the dummy 22 is suspended by the cable 120 from a pulley 124. The pulley system as shown in FIG. 8 is supported by a portable T-shaped stand 126. A base 128 supports the stand 126. The base can include wheels for easy mount of the portable stand 126. Additionally, a tab 130 extends from the base 128 and includes at least one hook 132 that fastens to the lower support hook 108 of the lower leg 100. The hook 132 and lower support hook 108 form a combined lower dummy support.

The counterbalancing means tends to return the dummy to its upright position after take down forces are exerted on the dummy.

The training dummy assembly of the present invention anticipates a means having a multiple pulley system including double, triple etc. sets of pulleys. A multiple pulley system can reduce the weight of the counterbalancing weight 118, and would be particularly useful with lighter dummy assemblies. A counterbalancing means of the present invention can also include an upper support spring or an upper support spring combined with a lower support as described above.

According to another embodiment of the invention as shown in FIGS. 9–11, the training dummy assembly includes a securing means comprising three sets of diametrically opposed holes 35 of the carrier 33, at least one set is aligned with the diametrically opposed holes 31 of the chamber 21. As described above, the carrier 33 rotates with respect to the torso 26 about the X axis of the upper arm attachment point 36. The carrier 33 is attached to the upper arm 38 and the securing mean stops the carrier at three discrete points as it rotates with respect to the chamber 31 and torso 26. The bolt 29 is inserted through diametrically opposed hole 31 of the chamber 21 and at least one set of diametrically opposed holes 35 of the carrier 33, and fastened to the nut 37. The securing means stops the rotation of the carrier 33 and attached upper arm 38 at a discrete point with respect to the torso 26.

The securing means enables the upper arm 38 to be positioned at three discrete arm positions with respect to the torso 26. The training dummy assembly 22 as shown in FIG. 11 illustrates one of the positioning arrangements of the upper arm 38 with respect to the torso 26. The training dummy assembly 22 as shown in FIG. 11 can be positioned into a boxing pose.

The foregoing description has been provided to clearly define and completely describe the present invention. Various modifications may be made without departing from the scope and spirit of the invention which is defined in the following claims.

What is claimed is:

1. A training dummy assembly in human form, comprising:

a torso having a longitudinal axis running a length of said torso, and including at least one upper arm attachment point having an XY & Z axis at each said attachment point, said X axis traversing said longitudinal axis of said torso, said Y axis parallel with said longitudinal axis of said torso, and said Z axis perpendicular to said X & Y axes;

at least one upper arm fastened to said torso at a respective said at least one upper arm attachment point;

a shoulder fastening means for fastening said at least one upper arm to said at least one upper arm attachment point of said torso, said shoulder fastening means enabling said at least one upper arm to rotate about the X axis and pivot about the Y & Z axes, said shoulder fastening means includes an assembly comprised of a combination swivel joint and pivoting hinge, wherein the swivel joint is fastened to said torso and said pivoting hinge is fastened to said at least one upper arm, said swivel joint includes at least two stops adjacent the pivoting hinge, said pivoting hinge includes at least one protuberance adjacent the swivel joint, said at least two stops in combination with said at least one protuberance limits the rotating range of said at least one upper arm to about 270° about the X axis, and a counter balancing means adapted for counter balancing a force applied to said dummy, said counter balancing means is attached to said torso.

2. The dummy of claim 1 wherein said at least one upper arm rotates at least about 180° about the X axis, pivots at least about 180° about the Y axis, and pivots at least about 180° about the Z axis.

3. The dummy of claim 1 wherein said at least one upper arm comprises a lower arm attachment point having an XY & Z axis at said lower arm attachment point, and further comprising a lower arm fastened to said at least one upper arm at said lower arm attachment point.

4. The dummy of claim 3 further comprising an elbow fastening means for fastening said lower arm to said lower arm attachment point of said at least one upper arm, said elbow fastening means enabling said lower arm to pivot about the X axis of said lower arm attachment point and rotate about the Y axis of said lower arm attachment point.

5. The dummy of claim 4 wherein said lower arm pivots at least about 90° about the X axis and rotates at least about 90° about said Y axis.

6. The dummy of claim 4 wherein said elbow fastening means includes an assembly comprised of a combination swivel joint and pivoting hinge, wherein the swivel joint is fastened to said at least one upper arm, said pivoting hinge including at least one protuberance adjacent the swivel joint, is fastened to said lower arm and at least two stops located at an end of said at least one upper arm adjacent the pivoting hinge, in combination with said at least one protuberance of the pivoting hinge, limits the rotating range of the lower arm to about 180° about the Y axis.

7. The dummy of claim 4 wherein said lower arm further comprises a hand attachment point having an XY & Z axis at said hand attachment point, and further comprising a hand fastened to said lower arm at said hand attachment point.

8. The dummy of claim 7 further comprising a wrist fastening means for fastening said hand to said hand attachment point of said lower arm, said wrist fastening means enabling said hand to pivot at least about 90° about said Z axis.

9. The dummy of claim 8 wherein said wrist fastening means includes a hinge with a base part and a single knuckle, said base part is fastened to said lower arm at said hand attachment point and said single knuckles is fastened to said hand.

10. The dummy of claim 8 wherein said torso further comprises a head attachment point having an XY & Z axis at said head attachment point, a head fastened to said torso at said head attachment point, further comprising a head fastening means for fastening said head to said torso, and enabling said head to pivot at least 90° about the Y axis of said head attachment point, and said counterbalancing means attached to said head.

11. The dummy of claim 10 wherein said torso further comprises at least one pelvis attachment point, a pelvis fastened to said torso at said pelvis attachment point, said pelvis further comprising at least one upper leg attachment point having XY & Z axis, an upper leg attached to said pelvis at said upper leg attachment point, further comprising an upper leg fastening means for fastening said upper leg to said pelvis and enabling said upper leg to pivot at least about 90° about the Y axis of said upper leg attachment point, said upper leg further comprising a lower leg attachment point, a lower leg attached to said upper leg at said lower leg attachment point and further comprising a lower leg fastening means for fastening said lower leg to said lower leg attachment point of said upper leg and enabling said lower leg to pivot at least about 90° about the Y axis of said lower leg attachment point.

12. The dummy of claim 1 wherein said counter balancing means includes at least a single pulley system wherein a counterbalancing weight is suspended from an upper support and said dummy is suspended from said upper support, said counterbalancing weight is equal to a weight of said dummy.

13. The dummy of claim 8 wherein said at least one upper arm, said lower arm, and said hand have an initial position, said dummy further comprising a returning means for returning said at least one upper arm, said lower arm and said hand back to their positions, after a rotating or a pivoting force is applied to said at least one upper arm, said lower arm, and said hand.

14. The dummy of claim 13 wherein said returning means includes a combination energy storing material and resilient covering securely attached to said dummy.

15. A training dummy assembly in human form comprising:

a head;

a torso attached to said head, said torso having a longitudinal axis running a length of said torso, including at least one head attachment point having an XY & Z axis, and at least one upper arm attachment point having an XY & Z axis at each said upper arm attachment point, said X axis traversing said longitudinal axis of said torso, said Y axis parallel with said longitudinal axis of said torso, and said Z axis perpendicular to said X & Y axes, said torso having an initial position;

a head fastening means for fastening said head to said torso including, at least one closed U-shaped finger attached to said head interconnected with and at least one closed U-shaped finger attached to said torso at said head attachment point, said head fastening means enables said head to pivot at least about 90° about the Y axis of said head, said head having a first original position;

at least one upper arm fastened to said torso at a respective said at least one upper arm attachment point, said at least one upper arm including a lower arm attachment point having an XY & Z axis, and said at least one upper arm including an initial position;

a shoulder fastening means for fastening said at least one upper arm to said torso including, at least one closed U-shaped finger attached to said torso at said upper arm attachment point, and interconnected with at least one closed U-shaped finger attached to said at least on upper arm, said shoulder fastening means enable said at least one upper arm to rotate at least about 180° about the X axis, pivot at least about 180° about the Y axis, and pivot at least about 180° about the Z axis;

a lower arm fastened to said at least one upper arm at said lower arm attachment point, said lower arm including a hand attachment point having an XY & Z axis, and said lower arm having an initial position;

an elbow fastening means for fastening said lower arm at said at least one upper arm, including at least one closed U-shaped finger attached to said at least one upper arm at said lower arm attachment point, interconnected with at least one closed U-shaped finger attached to said lower arm, said elbow fastening means enables said lower arm to pivot at least about 90° about said X axis and rotate at least about 90° about said Y axis;

a hand attached to said lower arm at said lower arm attachment point, and said hand having a first original position;

a wrist fastening means for fastening said hand to said lower arm including, at least one closed U-shaped finger attached to said lower arm at said hand attachment point, interconnected with at least one U-shaped finger attached to said hand, said wrist fastening means enable said hand to pivot at least about 90° about the Z axis;

returning means for returning said torso, said head, said at least one upper arm, said lower arm, and said hand back to their initial positions after a rotating or a pivoting force is applied to said torso, said head, said at least one upper arm, said lower arm, and said hand; and a counterbalancing means adapted for counterbalancing a force applied to said dummy, said counterbalancing means is attached to said head.

16. A training dummy assembly in human form comprising:

a torso having a longitudinal axis running a length of said torso, and including at least one upper arm attachment point having an XY & Z axis at each said attachment point, said X axis traversing said longitudinal axis of said torso, said Y axis parallel with said longitudinal axis of said torso, and said Z axis perpendicular to said X & Y axes;

a chamber forming part of said torso and encompassing said at least one upper arm attachment point, said chamber includes an outer surface;

at least one carrier slipped into said chamber and concentric with said chamber, said at least one carrier rotates with respect to said chamber about the X axis of said at least one upper arm attachment point, said at least one carrier and said chamber include a common securing means for securing said at least one carrier to said chamber, and for stopping said at least one carrier at least one discrete point as it rotates with respect to said chamber;

at least one upper arm fastened to said torso at a respective said at least one upper arm attachment point, said at least one upper arm is attached to said at least one carrier, and said securing means enable said upper arm to be positioned at least one discrete arm position with respect to said torso; and a counter balancing means adapted for counterbalancing a force applied to said dummy, said counterbalancing means is attached to said torso.

17. The dummy of claim 16 wherein said securing means is comprised of a bolt, two diametrically opposed holes of said chamber, a nut attached to the outer surface of said chamber and concentric with at least one of said diametrically opposed holes of said chamber, at least one set of diametrically opposed holes of said at least one carrier, at least one of said at least one set of diametrically opposed holes is aligned with said two diametrically opposed holes of said chamber, wherein said bolt is inserted through said diametrically opposed holes of said chamber, said at least one of diametrically opposed holes of said at least one carrier, and fastened to said nut, whereby stopping the rotation of said at least one carrier and attached upper arm at at least one discrete point with respect to said torso.

* * * * *